United States Patent [19]

Castonguay et al.

[11] Patent Number: 5,043,688

[45] Date of Patent: Aug. 27, 1991

[54] ACTUATOR-ACCESSORY INTERFACE UNIT FOR MOLDED CASE CIRCUIT INTERRUPTER

[75] Inventors: Roger N. Castonguay, Terryville; Thomas F. Papallo, Jr., Plainville, both of Conn.

[73] Assignee: General Electric Company, New York, N.Y.

[21] Appl. No.: 518,381

[22] Filed: May 3, 1990

[51] Int. Cl.[5] ..... H01H 9/00

[52] U.S. Cl. ..... 335/172; 335/202

[58] Field of Search ..... 335/8-10, 335/167, 175, 185, 189, 196, 202

[56] References Cited

U.S. PATENT DOCUMENTS

| | | | |
|---|---|---|---|
| 4,090,157 | 5/1978 | Rys | 335/8 |
| 4,736,174 | 4/1988 | Castonguay et al. . | |
| 4,806,893 | 2/1989 | Castonguay et al. . | |
| 4,894,631 | 1/1990 | Castonguay et al. . | |
| 4,913,503 | 4/1990 | Castonguay et al. . | |

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An integrated protection unit is a circuit interrupter which includes basic overcurrent protection facility along with selective electrical accessories. A molded plastic accessory access cover secured to the integrated protection unit cover protects the accessory components contained within the integrated protection unit cover from the environment. A combined overcurrent trip actuator and multiple accessory unit can be field-installed within the integrated protection unit. The combined actuator-accessory unit includes electronic control circuitry for the accessories along with mechanical trip and reset interface components. An actuator-accessory unit arranged within the interrupter cover interacts between the actuator-accessory unit and the interrupter operating mechanism to separate the interrupter contacts and interrupt a protected circuit.

12 Claims, 5 Drawing Sheets

ACTUATOR-ACCESSORY INTERFACE UNIT FOR MOLDED CASE CIRCUIT INTERRUPTER

BACKGROUND OF THE INVENTION

The trend in the circuit protection industry is currently toward complete circuit protection which is accomplished by the addition of supplemental protection apparatus to standard overcurrent protective devices, such as molded case circuit breakers. In the past, when such auxiliary protection apparatus or other circuit breaker accessories were combined with a standard circuit breaker, the accessories were usually custom-installed at the point of manufacture. The combined protective device, when later installed in the field, could not be externally accessed for inspection, replacement or repair without destroying the integrity of the circuit breaker interior. U.S. Pat. No. 4,894,631 describes a molded case circuit breaker containing an actuator-accessory unit which provides a wide variety of circuit protection accessory options. This patent is incorporated herein for purposes of reference and should be reviewed for its description of the state-of-the-art of such circuit breakers and accessory devices.

U.S. Pat. No. 4,913,503 describes a reset mechanism for a lower ampere-rated circuit interrupter usually employed as a "branch" circuit interrupter within industrial power distribution systems downstream from a higher ampere-rated "main" circuit interrupter. When actuator-accessory units are used within the higher-rated circuits, the actuator-accessory units are incapable of providing sufficient force, per se, to overcome the holding force of the powerful operating mechanism springs. Additional tripping force is provided by a supplemental tripping mechanism which interacts with the actuator-accessory unit through a sequential resetting system to insure that the actuator-accessory unit becomes reset before the main operating mechanism is reset.

U.S. Pat. application Ser. No. (41PR-6785) describes a sequential resetting system that interfaces between the tripping mechanism and the actuator-accessory unit of a higher-rated molded case circuit interrupter to insure that the actuator-accessory unit becomes reset before the main operating mechanism. U.S. Pat. application Ser. No. (41PR-6800) describes the supplemental tripping mechanism that interacts with the actuator-accessory unit to provide sufficient tripping force to articulate the circuit interrupter operating mechanism. Additional accessory devices, such as the bell alarm described in U.S. Pat. application Ser. No. 311,794 filed Feb. 17, 1989, and that described within U.S. Pat. application Ser. No. (41PR-6807) are often required with such circuit interrupters containing a sequential resetting system and a supplemental tripping mechanism. All of these Applications are incorporated herein for purposes of reference. In order to use standard accessory designs over a wide range of circuit interrupter ampere ratings, some means must be provided to operate the accessory devices within both higher as well as lower-rated circuit interrupters and some means must be provided to interface between the actuator-accessory and the supplemental tripping mechanism for tripping the interrupter operating mechanism and re-setting the actuator-accessory unit.

One purpose of this invention accordingly, is to describe an actuator-accessory interface unit that interacts between the actuator-accessory unit in the interrupter cover and the supplemental tripping unit within the interrupter case. Another purpose of this invention is to provide means for accurately aligning the actuator-accessory interface unit with the supplemental tripping mechanism when the interrupter cover is attached to the interrupter case.

SUMMARY OF THE INVENTION

An integrated protection unit which includes overcurrent protection along with auxiliary accessory function within a common enclosure contains an accessory cover for access to the selected accessory components to allow field installation of the accessory components. A combined actuator-accessory unit provides overcurrent, shunt trip or undervoltage release functions and is arranged within one part of the enclosure. The circuit interrupter operating mechanism interfaces with a sequential resetting system by means of a sequence drive lever rotatably connected with the operating mechanism cradle. An actuator-accessory cam interacts between the actuator-accessory unit and a supplemental tripping mechanism to articulate the operating mechanism and with the sequential resetting system to reset the actuator-accessory unit. A locating pin arranged within the interrupter cover accurately aligns the actuator-accessory cam with the supplemental tripping mechanism.

DESCRIPTION OF THE PREFERRED EMBODIMENT

Figure 1:
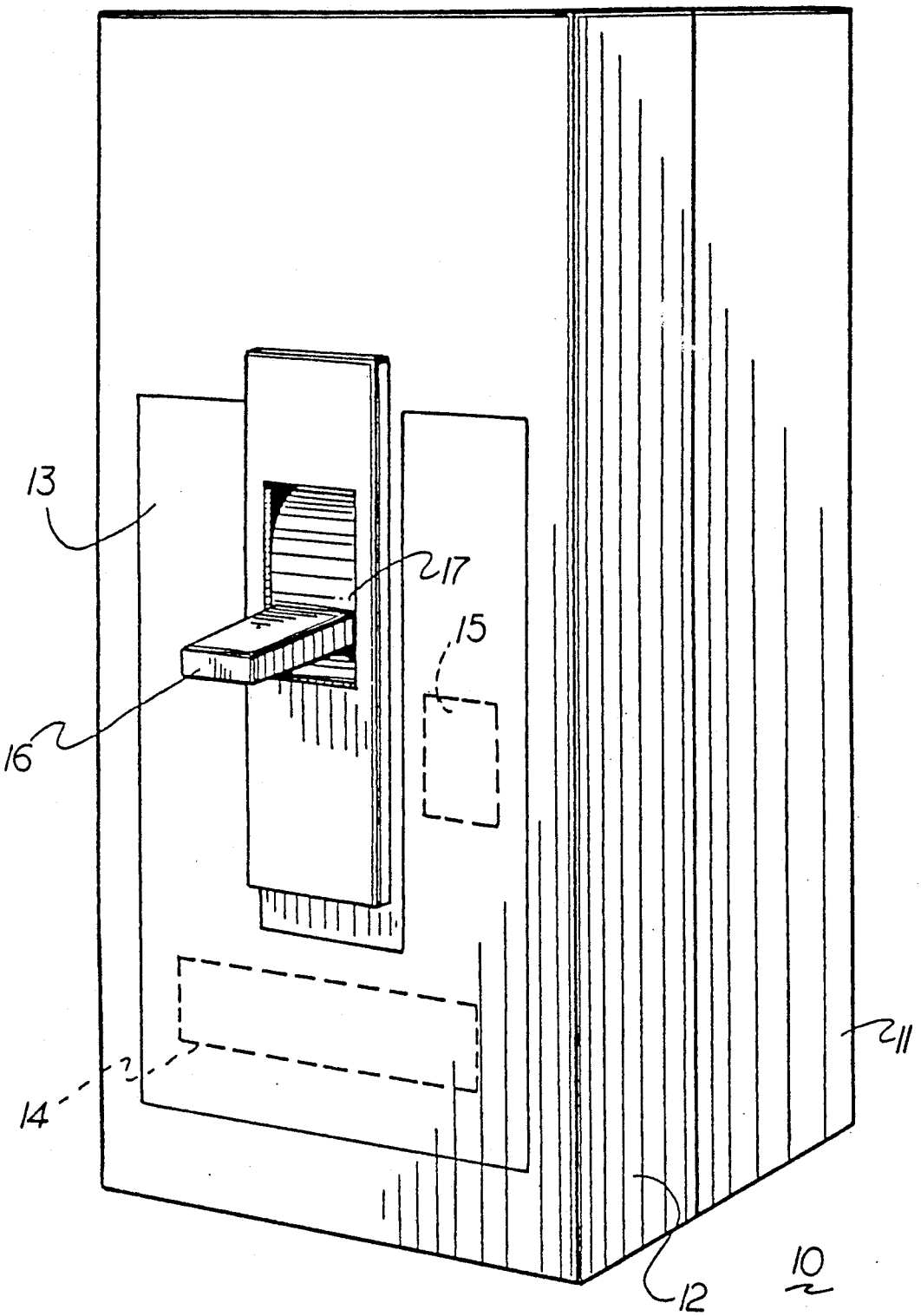
FIG. 1 is a top perspective view of a molded case circuit interrupter containing the actuator-accessory cam in accordance with the invention.

A higher-rated circuit interrupter 10, as described earlier, is depicted in FIG. 1 and consists of a molded plastic case 11 to which a molded plastic cover 12 is fixedly secured. An accessory cover 13 is attached to the circuit interrupter cover and provides access to an electronic trip unit 14 and an actuator-accessory unit 15. An operating handle 16 extends through the circuit interrupter cover by means of an access slot 17 and provides manual intervention to turn the circuit interrupter movable contact 19 at the end of the movable contact arm 18 and the fixed contact 20 on the fixed contact support 21 between their open and closed positions as best seen by referring now to the following FIGS. 2–4.

Figure 2:
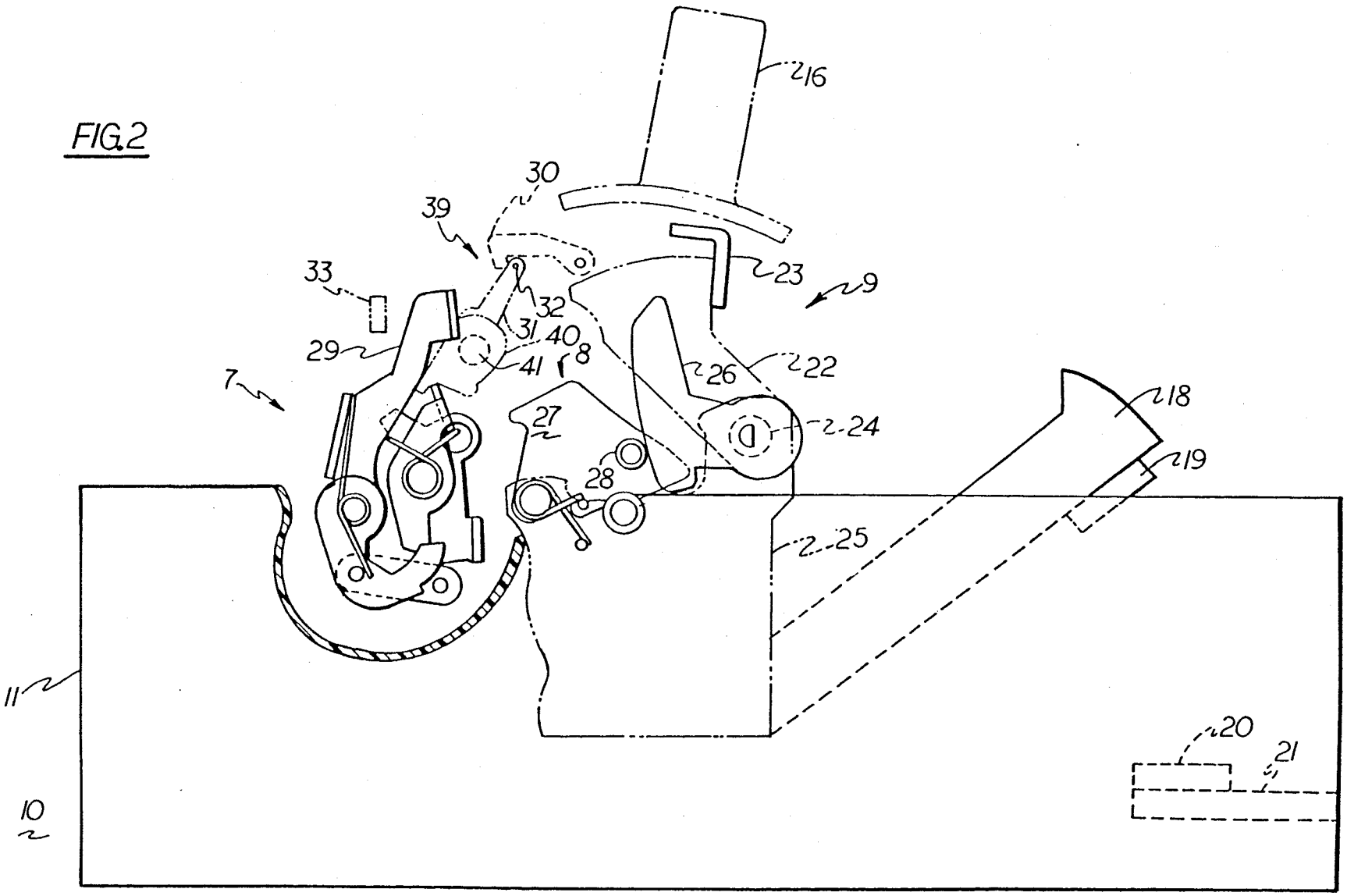
FIG. 2 is an enlarged cutaway side view of the circuit interrupter of FIG. 1 detailing the arrangement of the actuator-accessory unit relative to the sequential resetting system and supplemental tripping mechanism.

On the circuit interrupter 10 shown in FIG. 2 the operating handle 16 is in a TRIPPED condition such that the operating mechanism generally depicted at 9 has rotated the operating mechanism cradle 22 which allows the movable contact arm 18 to rotate to its OPEN position and thereby separate the movable contact 19 from the fixed contact 20 to interrupt the circuit current. The operating mechanism is described within U.S. Pat. No. 4,736,174 and should be reviewed for its teaching of the articulation of the operating mechanism to separate the interrupter contacts upon occurrence of an overcurrent condition for a predetermined time delay. It is to be noted that the circuit breaker contacts can be separated by manual intervention of the operating handle 16 and handle yoke 23 to turn the operating mechanism between its closed and open conditions without releasing the operating mechanism cradle 22 from its latched condition. The sequential resetting system 8 in the aforementioned U.S. Pat. application Ser. No. (41PR-6785) includes a drive lever 26 that is attached to the cradle pivot 24 on the operating mechanism sideframe 25. It is important to note that the drive lever only rotates when the circuit breaker operating mechanism rotates and is depicted in FIG. 2 in its TRIPPED position away from the drive roller 28 that is attached to the reset lever 27. The reset lever is in its rest position with the drive roller out of contact with the drive lever 26. The supplemental tripping mechanism 7 which includes a trip link 29 interacts with the resetting system 8 and with the actuator-accessory cam 31 in the manner described within the aforementioned U.S. Pat. applications which should be reviewed for the teachings contained therein. Suffice for an understanding of this invention, the actuator-accessory cam 31, which is shown in phantom, is located within the interrupter cover and is retained under the actuator-accessory latch 30 by means of the latch pin 32. The actuator-accessory latch and actuator-accessory cam are fully described within U.S. Pat. No. 4,806,893 which Patent is incorporated herein for purposes of reference and should be reviewed for its description of the interaction between the actuator-accessory cam 31 and the operating mechanism trip bar 33. The actuator-accessory cam 31 is part of the inventive actuator-accessory interface unit 39 which also includes a cylindrical body member 41 with a cam-shaped projection 40 attached at one end thereof.

Figure 3:
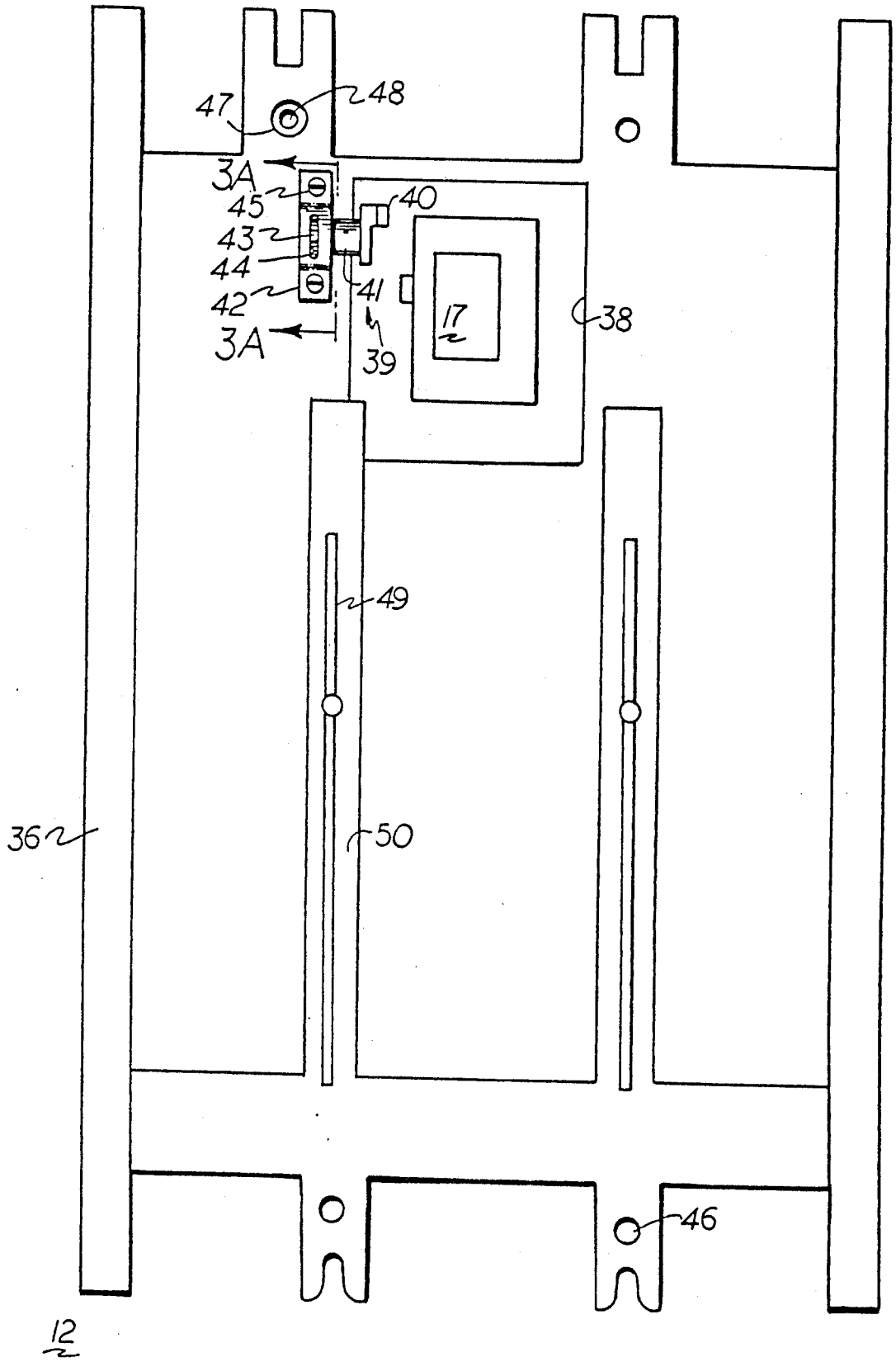
FIG. 3 is an enlarged plan view of the underside of the cover used with the circuit interrupter of FIG. 1, in a TRIPPED condition.
Figure 3A:
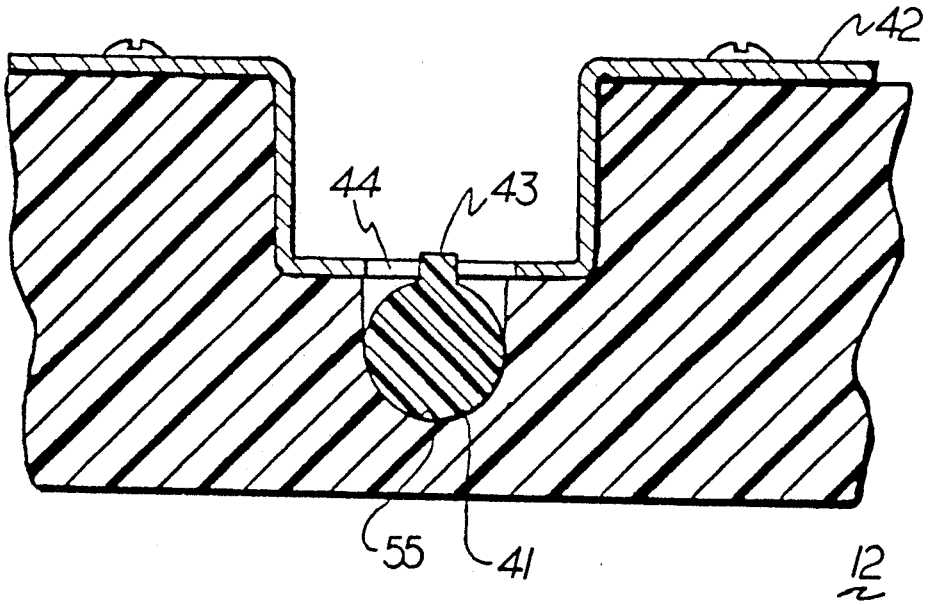
FIG. 3A is an enlarged sectional view of the cover of FIG. 3 viewed through 3A—3A plane.

The actuator-accessory interface unit 39 hereafter "interface unit" is arranged on the interior surface of the circuit interrupter cover 12 as best seen by referring now to FIGS. 3 and 3A. As described in the aforementioned U.S. Pat. No. 4,806,893, the actuator-accessory latch is attached to the actuator-accessory unit 15 (FIG. 1) which is arranged in a recess on an opposite side of the cover from that of the interface unit 39. The interface unit is attached to the underside of the interrupter cover by means of a U-shaped slotted bracket 42 fastened to the underside of the interrupter cover by a pair of screws 45 and arranged over the cylindrical body member 41 such that a projection-guide 43 formed on the body member extends through a narrow slot 44 formed in the support bracket. The actuator-accessory cam-projection 40 is positioned at the end of the cylindrical body member and is comprised of a fiber-type durable material. The projection-guide 43 provides controlled back and forth movement to the cylindrical body member 41 as best seen by referring to FIG. 3A.

The projection-guide 43 stops at the opposite sides of slot 44 to control the alignment of the cylindrical body member 41 which is trapped between the U-shaped bracket 42 and a curvilinear slot 55 formed within the interrupter cover 12.

Figure 4:
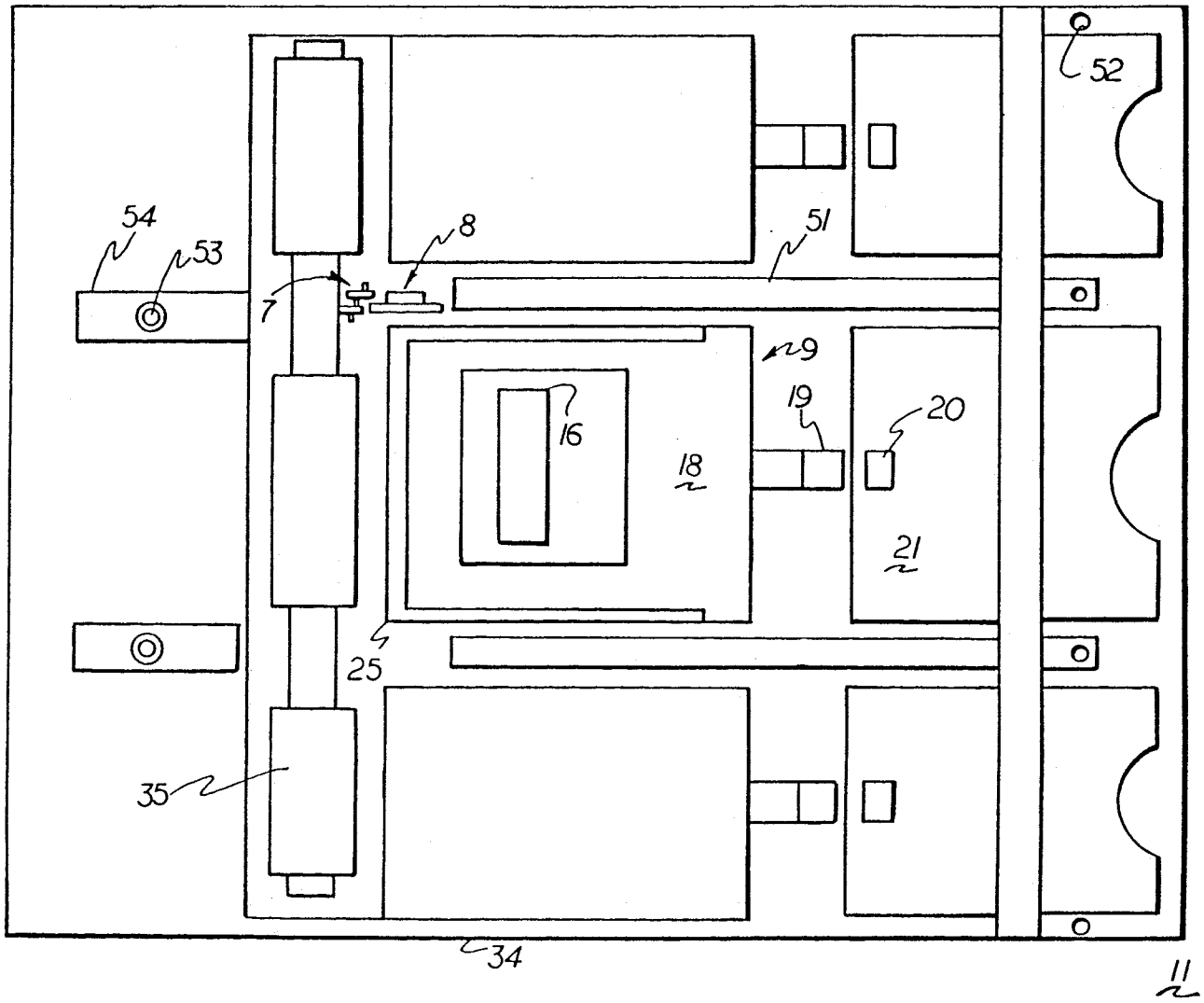
FIG. 4 is an enlarged plan view of the underside of the cover used with the circuit interrupter of FIG. 1.

The careful alignment between the interface unit 39 in the interrupter cover 12 and the supplemental tripping mechanism 7 and sequential resetting system 8 both arranged in the interrupter case 11 is best seen by referring now to FIGS. 3 and 4.

The interrupter cover 12 includes opposing plastic sidewalls 36 with intervening interior walls 50 as shown in FIG. 3. Elongated ribs 49 extend upwards from the interior wall and are received within corresponding elongated slots 51 formed within the interrupter case 11 shown in FIG. 4. The arrangement of the ribs within the elongated slots deters lateral movement between the interrupter case and the interrupter cover. The tapered post 47 surrounding the thru-hole 48 in the interrupter cover is located a predetermined distance from the interface unit 39 while the tapered threaded opening 53 formed within the projection 54 formed within the interrupter case is located a predetermined distance from the supplemental TRIPPING mechanism 7. When the interrupter cover is robotically assembled to the interrupter case, the tapered post exactly positions the interface unit 39 over the supplemental tripping mechanism 7. Also shown within the interrupter case 11 is the location of the movable contact arm 18 and attached movable contact 19 relative to the fixed contact 20 and fixed contact support 21. The movable contact is shown separated from the fixed contact on the fixed contact support since the crossbar 35, next to the sideframe 25 within the operating mechanism 9 which controls the movable contact arm, is in a TRIPPED position and the operating handle 16 is in its TRIPPED position. The sidewalls 34 formed on the opposing sides of the interrupter case include a plurality of threaded openings 52 which cooperate with corresponding thru-holes 46 formed on the interrupter cover 12 in order to securely fasten the interrupter cover to the case after the interface unit 39 is positioned over the supplemental tripping mechanism, as described earlier. The operating handle 16 is automatically positioned within the handle recess 38 formed in the interrupter cover and which contains the handle operator access slot 17 through which the handle extends as shown earlier in FIG. 1.

Having thus described our invention, what we claim as new and desire to secure by Letters Patent is:

1. A molded case circuit interrupter comprising:

a molded plastic circuit breaker case and circuit breaker cover;

an operating mechanism within said circuit breaker case arranged for automatically separating a pair of contacts within said circuit breaker case upon occurrence of an overcurrent condition within a protected circuit;

an accessory cover;

an actuator-accessory unit within said accessory cover; and an actuator-accessory interface unit within said circuit breaker cover and partially extending within said circuit breaker case for articulating said operating mechanism to separate said contacts upon actuation of said actuator-accessory unit.

2. The circuit interrupter of claim 1 wherein said interface unit includes a cylinder rotatably mounted to an underside of said circuit breaker cover.

3. The circuit interrupter of claim 1 wherein said interface unit further includes a cam member upstanding from one end of said cylinder and including a cam-shaped projection.

4. The circuit interrupter of claim 2 wherein said cylinder is attached to said circuit breaker cover by means of an apertured bracket.

5. The circuit interrupter of claim 4 including a curvilinear slot formed within said circuit breaker cover, said cylinder being trapped between said slot and said bracket to thereby provide support and rotation to said cylinder.

6. The circuit interrupter of claim 5 including an upwardly-extending projection on said cylinder protruding through a slot in said bracket thereby controlling alignment within confines defined by said slot.

7. The circuit interrupter of claim 4 wherein said bracket comprises a U-shaped configuration having a bight joined by a pair of opposing sides and wherein said slot is arranged through said bight.

8. The circuit interrupter of claim 7 wherein said circuit breaker cover further includes a recess formed on said underside and wherein said opposing sides and side bight extend within said recess.

9. The circuit interrupter of claim 1 further including a supplemental tripping system within said circuit breaker case for articulating said operating mechanism upon actuation of said actuator-accessory unit.

10. The circuit interrupter of claim 9 wherein said circuit breaker cover further includes a tapered post arranged on said circuit breaker cover a fixed distance from said interface unit and said circuit breaker case includes a flanged opening arranged a fixed distance from said supplemental tripping system for receiving said post when said circuit breaker cover is attached to said circuit breaker case to position said interface unit over said supplemental tripping system.

11. The circuit interrupter of claim 9 including ribs extending from and integrally-formed within said circuit breaker cover and corresponding elongated slots integrally-formed within said circuit breaker case to prevent relative movement between said circuit breaker cover and said circuit breaker case when said circuit breaker cover is attached to said circuit breaker case.

12. The circuit interrupter of claim 2 wherein said cylinder comprises a fiber composition.

* * * * *